US011331533B1

(12) United States Patent
Razon

(10) Patent No.: US 11,331,533 B1
(45) Date of Patent: May 17, 2022

(54) YOGA BLOCK

(71) Applicant: Eli Razon, Maple Glen, PA (US)

(72) Inventor: Eli Razon, Maple Glen, PA (US)

( * ) Notice: Subject to any disclaimer, the term of this patent is extended or adjusted under 35 U.S.C. 154(b) by 12 days.

(21) Appl. No.: 16/829,721

(22) Filed: Mar. 25, 2020

Related U.S. Application Data

(60) Provisional application No. 62/824,852, filed on Mar. 27, 2019.

(51) Int. Cl.
*A63B 21/00* (2006.01)
*A63B 6/00* (2006.01)

(52) U.S. Cl.
CPC ..... *A63B 21/4037* (2015.10); *A63B 6/00* (2013.01); *A63B 21/4033* (2015.10)

(58) Field of Classification Search
CPC ... A63B 21/4033; A63B 21/4037; A63B 6/00; A45C 2003/007; B65D 71/06; B65D 71/12; B65D 71/38; B65D 5/00; B65D 5/009; B31D 1/0031; B31D 3/00; B31D 3/02; B31D 3/0207; B31D 3/0223
USPC ..... 496/966; 206/315.1, 442
See application file for complete search history.

(56) References Cited

U.S. PATENT DOCUMENTS 2,320,006 A * 5/1943 Moore ..... B65D 5/00 229/120.09
2012/0233772 A1* 9/2012 Wang ..... A47G 27/0237 5/417
2015/0001110 A1* 1/2015 Chen ..... A63B 71/0036 206/315.1
2019/0383347 A1* 12/2019 Van den Avont ..... F16F 1/37
2020/0207507 A1* 7/2020 Tuhkunen ..... B65D 5/42

* cited by examiner

*Primary Examiner* — Nyca T Nguyen
*Assistant Examiner* — Zachary T Moore

(57) ABSTRACT

A yoga block formed from one or more layers of rectangularly-shaped interior composite structures and a wraparound cover material forming open outer corners into the composite structures. The yoga block is optionally in kit form with the entire wraparound cover material provided on a single flat sheet with the interior composite structures for assembly of the yoga block from the kit.

9 Claims, 11 Drawing Sheets

TC3
41
41
TC2
15c
15d
16
15b
15e
15a
TC4
TC1
TJ2
TJ1

TC4
TC1
15o
15k
BC4
BC1
SJ2
SJ1

YOGA BLOCK

CROSS REFERENCE TO RELATED APPLICATIONS

This application claims the benefit of U.S. Provisional Application No. 62/824,852, filed Mar. 27, 2019, hereby incorporated by reference in its entirety.

FIELD OF THE INVENTION

The present invention is an environmentally and ecologically friendly yoga block and a method of method of making such yoga block.

BACKGROUND OF THE INVENTION

Yoga blocks are used in practicing yoga and more generally, in meditation practices. Yoga blocks are used, for example, to sit on; for support in reclined backbends; or to reach for them in standing balancing poses. Yoga blocks are typically formed from foam, cork, wood or bamboo.

It is one object of the present invention to provide a yoga block formed from environmentally and ecologically friendly materials while being constructed for comfortable use particularly in the practice of yoga or meditation.

BRIEF SUMMARY OF THE INVENTION

In one aspect the present invention is a yoga block formed from a vertically-oriented stack of a rectangularly-shaped recyclable composite sandwich structure having a honeycomb core. Each structure is attached to an upper facing sheet and a lower facing sheet. The vertically-oriented stack forms a rectangularly-shaped interior of the yoga block. An outer yoga block cover is formed from a recyclable corrugating material having a linerboard. The outer yoga block cover is formed with an outer corner opening into the rectangularly-shaped interior of the yoga block at each one of the four top and side corners, and at each one of the four bottom and side corners to eliminate sharp 90 degree corners or edges of the yoga block, which provides a yoga block with external corners that are comfortably shaped for handling of the yoga block during use.

In another aspect the present invention is a method of assembling a yoga block formed from a vertically-oriented stack of a rectangularly-shaped recyclable composite sandwich structure having a honeycomb core. Each structure is attached to an upper facing sheet and a lower facing sheet. The vertically-oriented stack forms a rectangularly-shaped interior of the assembled yoga block. An outer yoga block cover is formed from a recyclable corrugating material having a linerboard. The outer yoga block cover is formed with an outer corner opening into the rectangularly-shaped interior of the yoga block at each one of the four top and side corners and at each one of the four bottom and side corners to eliminate sharp 90 degree corners or edges of the yoga block, which provides an assembled yoga block with external corners that are comfortably shaped for handling of the yoga block during use.

In another aspect the present invention is a yoga block construction kit for a yoga block of the present invention. The yoga block construction kit comprises a vertically-oriented stack of a rectangularly-shaped composite sandwich structure and a flat sheet of a corrugating material. The vertically-oriented stack of a rectangularly-shaped composite sandwich structure has a honeycomb core attached to an upper facing sheet and a lower facing sheet. The flat sheet of corrugating material has a linerboard that includes the top, bottom and sides of the yoga block that is used to form an outer yoga block cover of the assembled yoga block with an outer corner opening into the rectangularly-shaped interior of the yoga block at each one of the four top and side corners and at each one of the four bottom and side corners to eliminate sharp 90 degree corners or edges of the constructed yoga block to provide an assembled yoga block with external corners that are comfortably shaped for handling of the constructed yoga block during use.

The above and other aspects of the invention are set forth in this specification and the appended claims.

BRIEF DESCRIPTION OF THE DRAWINGS

The appended drawings, as briefly summarized below, are provided for exemplary understanding of the invention, and do not limit the invention as further set forth in this specification and the appended claims:

DETAILED DESCRIPTION OF THE INVENTION

In one embodiment a yoga block of the present invention comprises a vertically-oriented stack of at least two rectangularly-shaped composite sandwich structures with each of the at least two rectangularly-shaped composite sandwich structures having a honeycomb core attached to an upper facing sheet and a lower facing sheet. The vertically-oriented stack forms a rectangularly-shaped interior of the yoga block. In this embodiment the outer yoga block cover comprises a corrugating material having a linerboard. The outer yoga block cover forms a plurality of outer cover corner openings into the rectangularly-shaped interior yoga block at each one of four top and side corners and at each one of the four bottom and side corners. In this embodiment the yoga block's honeycomb core comprises a honeycomb paper core that has a hexagonally-shaped honeycomb paper core. In this embodiment the yoga block's corrugating material comprises a fluting material having a linerboard formed from kraftliner or testliner.

Figure 1:
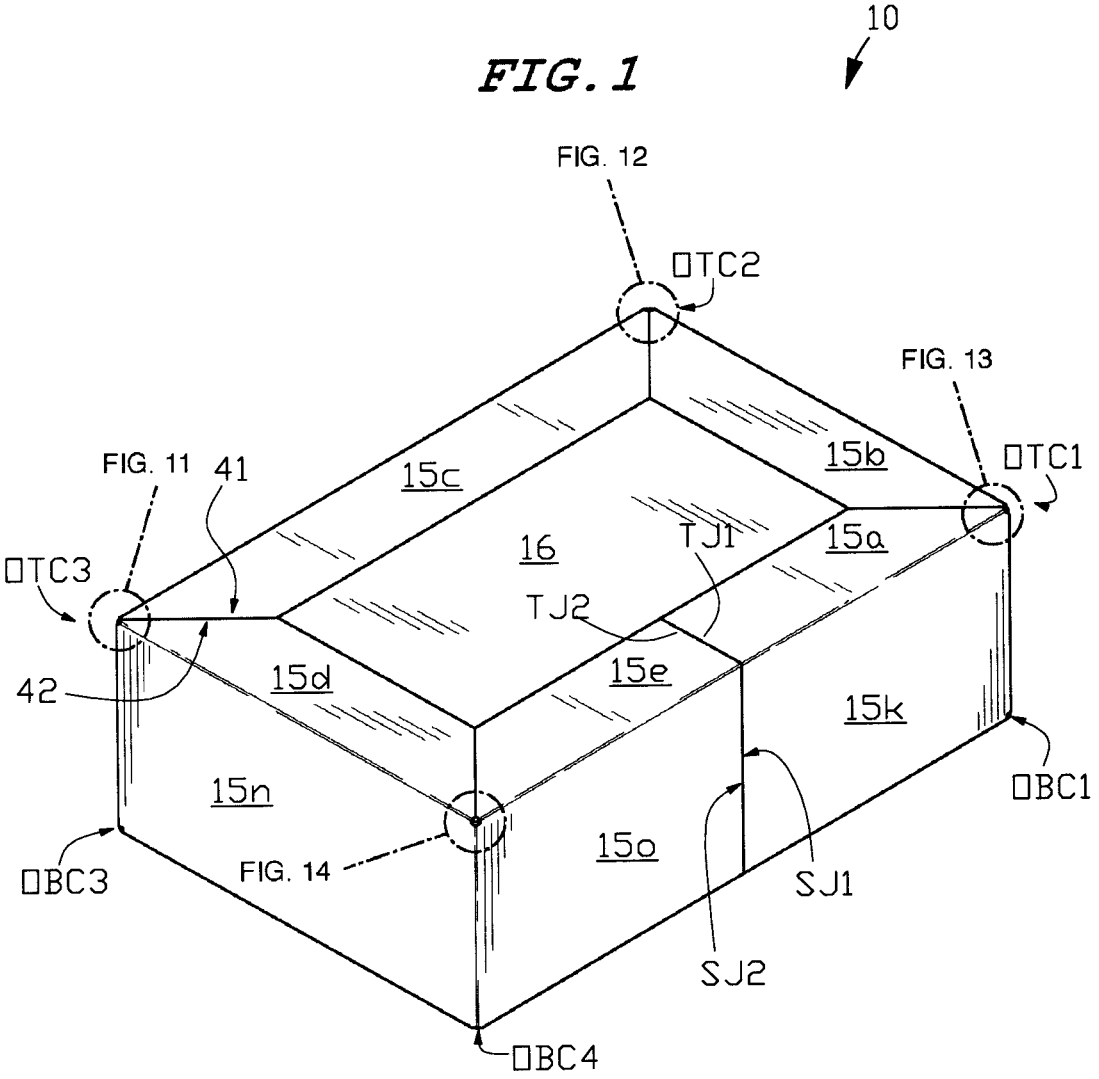
FIG. 1 is a top perspective view of one example of a yoga block of the present invention.

There is shown in the drawings one embodiment of a yoga block 10 of the present invention. In this example yoga block 10 is formed from a double layer of rectangularly-shaped interior yoga block 12 shown, for example, in FIG. 7; and a wraparound side yoga block outer cover 15 and a top central yoga block outer cover 16 and a bottom central yoga block outer cover 17 shown in one example of a flat preformed configuration in FIG. 4 before being attached to and cover the double layer of rectangularly-shaped interior yoga block as shown in FIG. 1.

Figure 4:
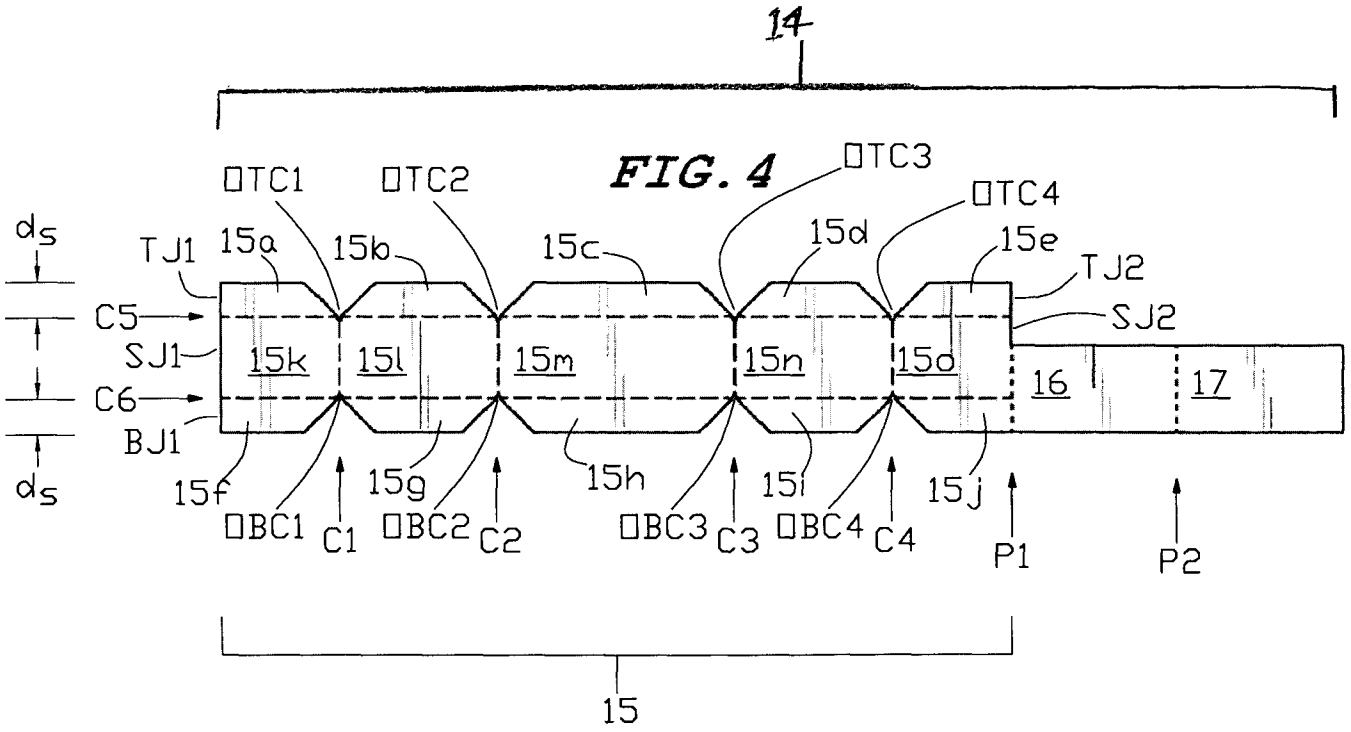
FIG. 4 is a flat plan view of one example of a cover material for the yoga block in FIG. 1.

In FIG. 4, the wraparound side outer cover 15, top central outer cover material 16 and bottom central outer cover material 17 is preformed as a unitary flat sheet 14 of a corrugating material having a liner board that forms an outer corner opening into the double layer of rectangularly-shaped interior yoga block 12 at each one of the four top and side corners (edges) and at each one of the four bottom and side corners (edges) when wrapped around the double layer of rectangularly-shaped interior yoga block 12. The unitary flat sheet may be formed from a recyclable material is some embodiments of the invention.

In one embodiment of the invention the outer yoga block cover material comprises containerboard, also known as corrugated case material (CCM), which is a type of paperboard formed from a linerboard and a corrugating medium that is also known in the art as fluting. The corrugating contributes to a cushioning effect when the yoga block is in use. The corrugating medium of flat sheet 14 is visible at the corners of yoga block 10, for example, in FIG. 11 through FIG. 14. In this example, the linerboard is formed from virgin pulp called kraftliner or recycled linerboard known as testliner. The corrugating medium may be a recycled medium, called wellenstoff, or virgin, which is called a semichemical medium for the type of pulp used in its production.

In one embodiment of the invention the containerboard preform (unitary flat sheet 14) has an overall thickness (of linerboard and corrugating medium) of 0.12 inch (3.0 mm) that can be die-cut from containerboard stock to the flat preform shape shown in FIG. 4.

One example of an acceptable commercially available containerboard stock is available from WestRock Company (Norcross, Ga., USA).

The following crease lines are illustrated as dashed lines in FIG. 4 and can be either machine made or hand made in flat preform sheet 14.

Figure 2:
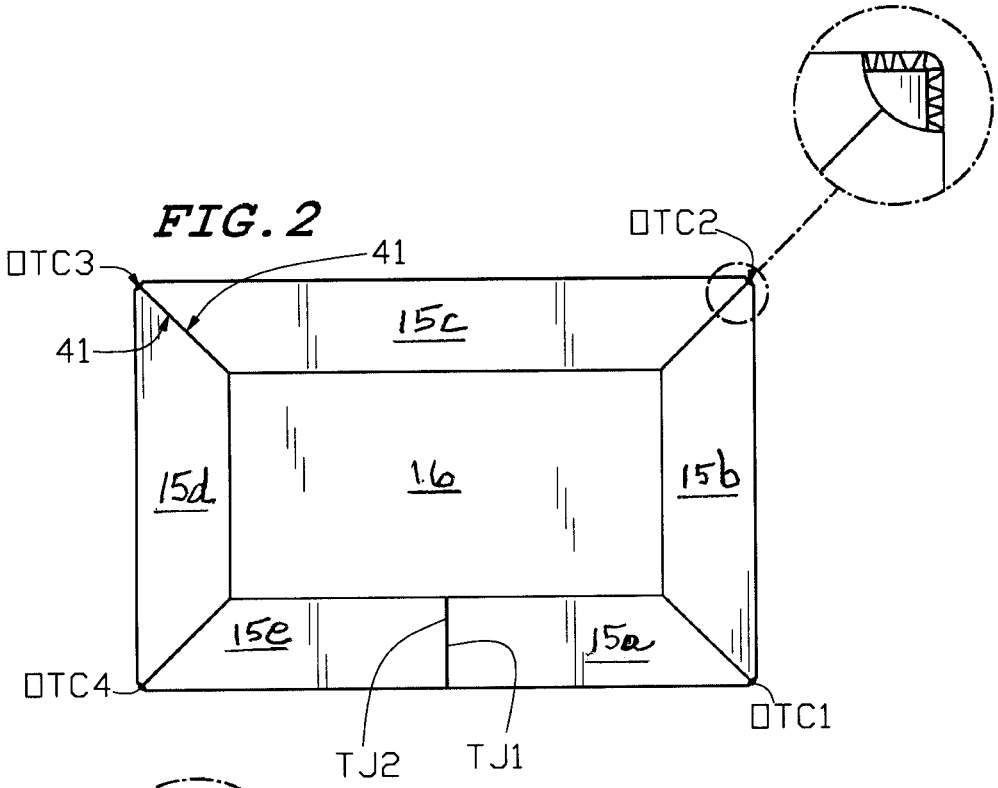
FIG. 2 is a top plan view of the yoga block in FIG. 1 with a detail enlarged view of one top corner view.
Figure 3:
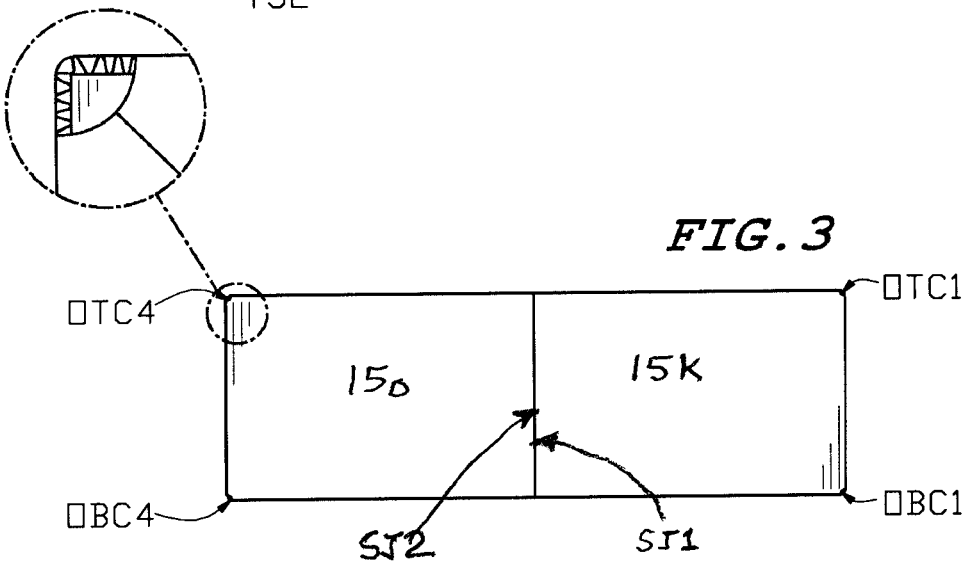
FIG. 3 is a front elevation view of the yoga block in FIG. 1 with a detail enlarged view of one top corner view.

Top crease line C5 and bottom crease line C6 establish the boundary between top block edge segments 15*a* through 15*e* and bottom block edge segments 15*f* through 15*j* from block side segments 15*k* through 15*o* of flat preform sheet 14 when the wraparound side block cover material is attached to the sides and top and bottom edges of yoga block 10 as shown, for example, in FIG. 1 through FIG. 3 in one embodiment of the invention.

In one embodiment of the invention the top block edge segments (15*a*-15*e*) and the bottom block edge segments (15*f*-15*j*) extend for a distance ds (shown in FIG. 4) of one inch from their respective adjacent and attached side segments. Distance ds will vary depending upon the particular size of a yoga block of the present invention.

Side corner crease lines C1 through C4 establish the block's side corner boundaries between wraparound sides 15*k* through 15*o*, respectively, when the preform flat sheet 14 is wrapped around and attached to the rectangularly-shaped interior yoga block as shown, for example, in FIG. 1.

Figure 9:
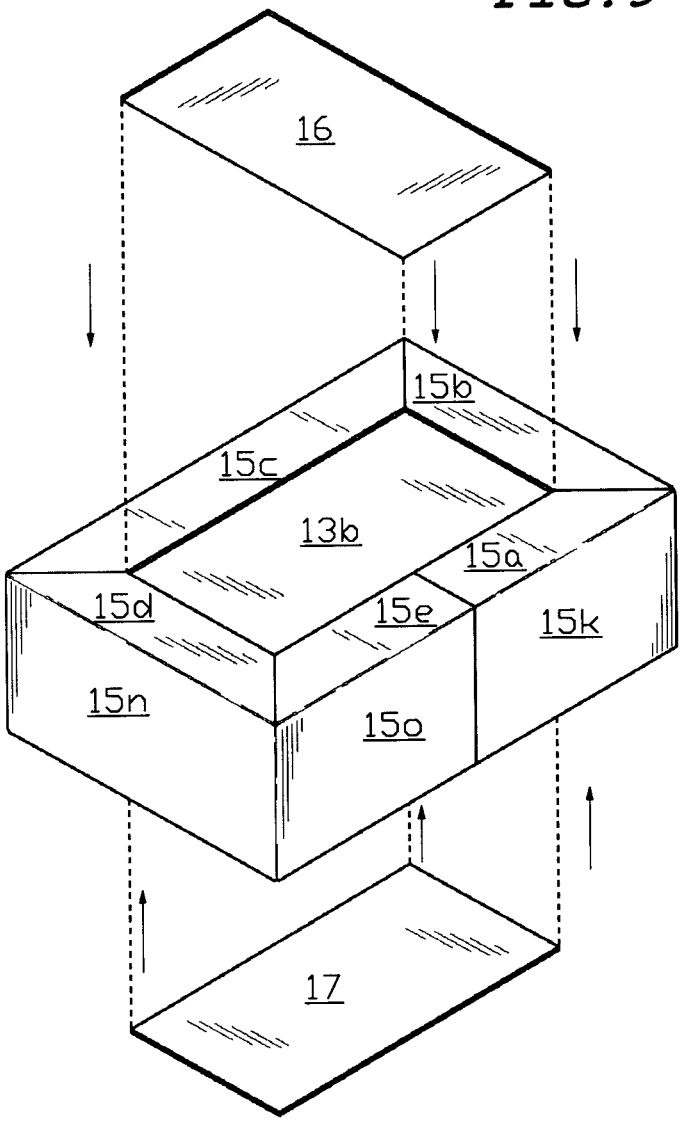
FIG. 9 is an exploded view of the yoga block in FIG. 1 with the central top cover material and the central bottom cover material not installed over the internal material.

In the embodiment of the invention shown in the figures, perforation lines P1 and P2 are shown as dashed lines in the FIG. 4 flat preform sheet and can be either machine made or hand made in flat preform sheet 14 to facilitate separation of the top central outer block cover material 16 and the bottom central outer block cover material 17 from flat preform sheet 14 to allow attachment of the top central outer block cover material 16 and the bottom central outer block cover material 17 over the top and bottom central regions of the double layer of rectangularly-shaped interior yoga block 12 as shown in FIG. 9 where the top central outer cover material and bottom central outer cover material is prepared for respective lowering and raising attachment over the double layer of rectangularly-shaped interior yoga block 12.

Figure 15:
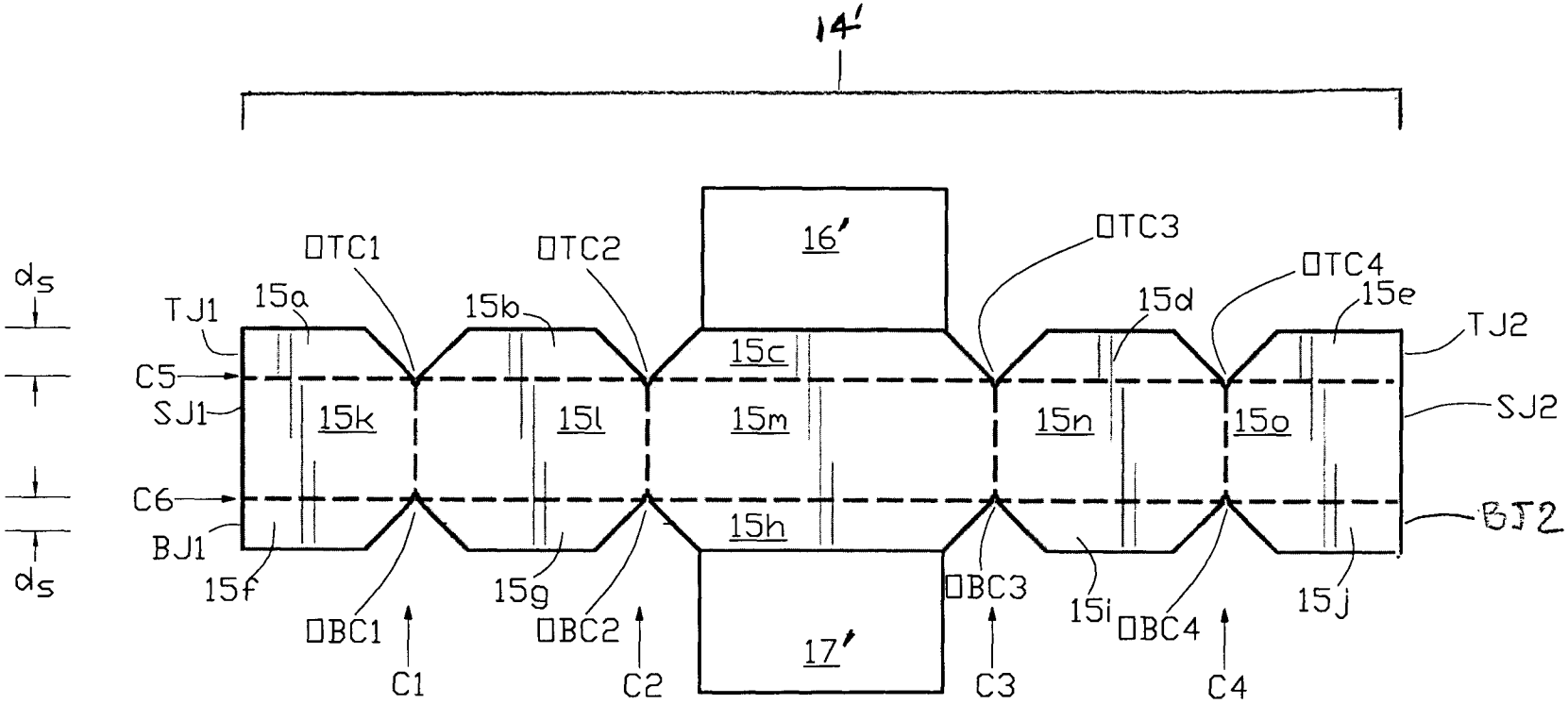
FIG. 15 is a flat plan view of another example of a cover material for a yoga block of the present invention.

In another embodiment of the invention the top central outer cover material 16' and the bottom central outer cover material 17' is included in alternative flat preform sheet 14' in FIG. 15 by extending the upper horizontal length of the block's top edge segment 15*c* to replace separate (perforated) top central outer cover material 16 in FIG. 4 and extending the lower horizontal length of the block's bottom edge segment 15*h* to replace separate (perforated) bottom central outer cover material 17 in FIG. 4.

Figure 6:
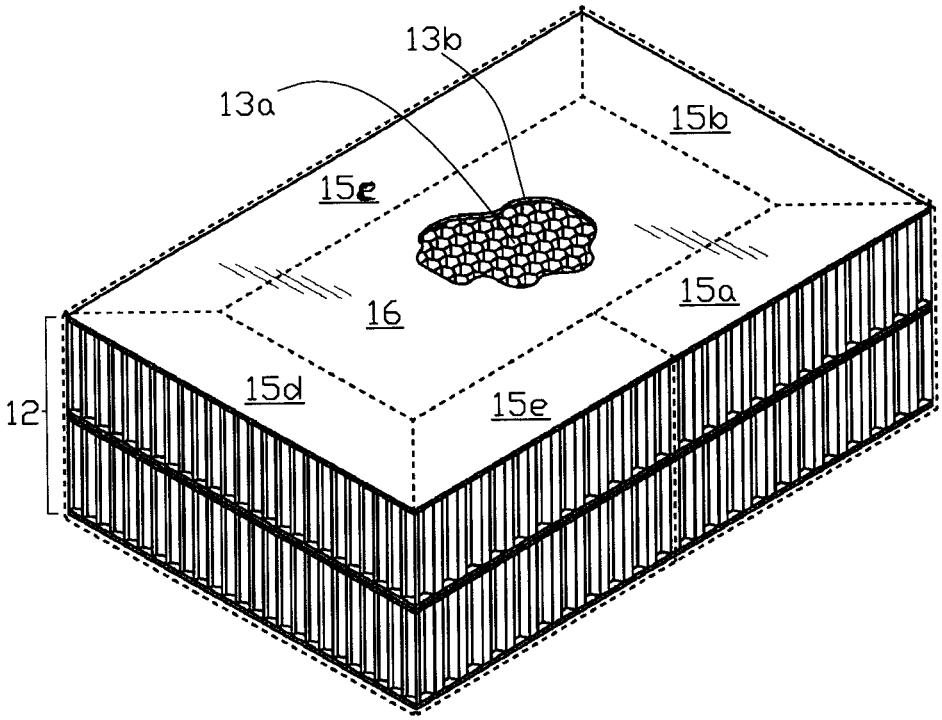
FIG. 6 is a perspective view of one example of a yoga block internal material forming the vertically oriented stacks for the yoga block in FIG. 1 with the side cover material removed and the top cover material shown except for a central cutout section to illustrate the top of the yoga block internal material.
Figure 7:
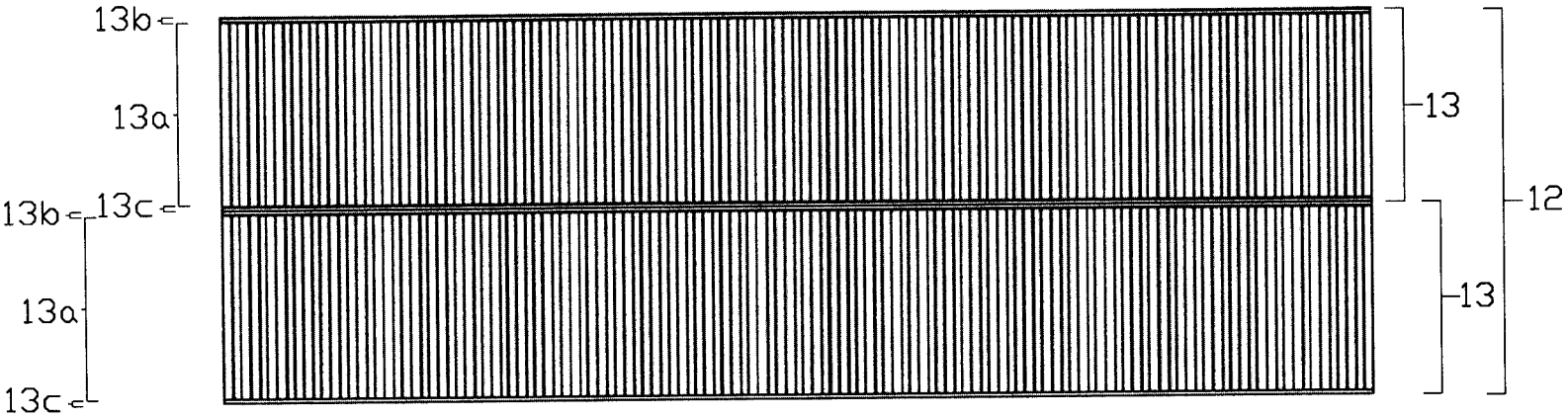
FIG. 7 is a front elevation view of the yoga block internal material show in FIG. 6.
Figure 8:
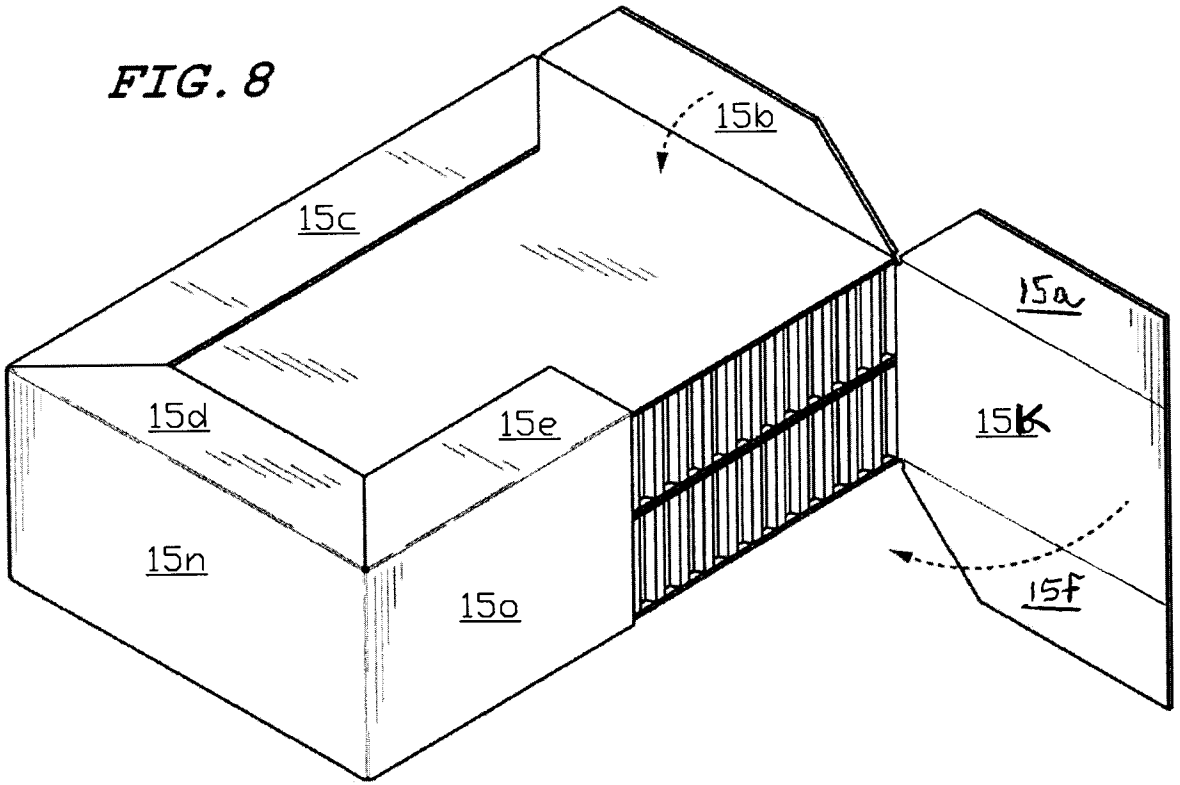
FIG. 8 is a perspective view of the yoga block in FIG. 1 with the yoga block cover material partially installed around the internal material.

In the embodiment of the invention shown in the drawings, each one of the double layer of rectangularly-shaped interior yoga block 12 comprises a rectangularly-shaped composite structure 13 as shown, for example, in FIG. 7 with honeycomb core 13*a* attached to an upper facing sheet 13*b* and a lower facing sheet 13*c*. In this embodiment the honeycomb core 13*a* comprises a hexagonally-shaped hollow honeycomb cells formed from a paperboard material with upper facing sheet 13*b* and lower facing sheet 13*c* as illustrated in FIG. 6 and FIG. 7. The lower facing sheet of the upper composite structure is fixed to the upper facing sheet of the lower composite structure, for example, with an adhesive. Preferably, but not limiting, at least a double layer of composite structures forming the rectangularly-shaped interior yoga block are provided for sufficient vertical load bearing strength for yoga block 10. One acceptable composite structure for the double layer of rectangularly-shaped interior yoga block 12 is available from Hexacomb Corporation (North Haven, Conn., USA).

Preferably, but not limiting, is a composite structure having an overall height of 1.5 inches for a double layer interior yoga block 12 having an overall height of 3 inches. Other typical, but non-limiting configurations of a yoga block of the present invention are a quadruple layer interior yoga block having an overall height of 6 inches; and a sextuple layer interior yoga block having an overall height of 9 inches. A single layer of composite structure with sufficient vertical load bearing strength for the rectangularly-shaped interior yoga block can be provided in other embodiments of the invention. Although the multiple rectangularly-shaped composite structures forming the interior yoga block are identical this is not a limitation of a yoga block of the present invention. For example the multiple composite structures may have different heights and honeycomb structures.

In the embodiment of the invention shown in the drawings each side corner crease line (C1 through C4) terminates at opposing top and bottom ends in an outer cover corner opening into the rectangularly-shaped interior yoga block 12. The outer cover corner opening forms an open arcuate corner region that angularly extends at opposing arcuate ends in a straight line to the interior boundary of a top or bottom edge segment to form the outer cover corner top (OTC) and bottom (OBC) cover corner openings OTC1 through OTC4 and OBC1 through OBC4 as shown in the figures.

Figure 5:
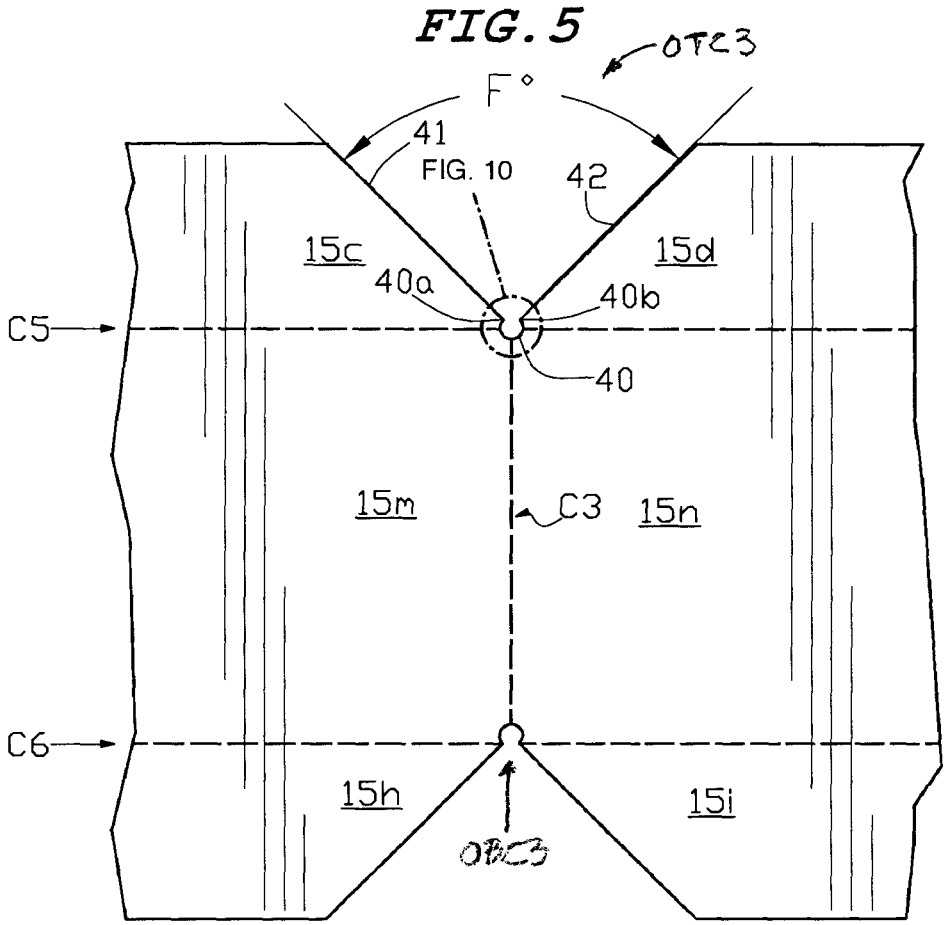
FIG. 5 is a detail enlarged view of one open corner region in the cover material shown in FIG. 4.
Figure 10:
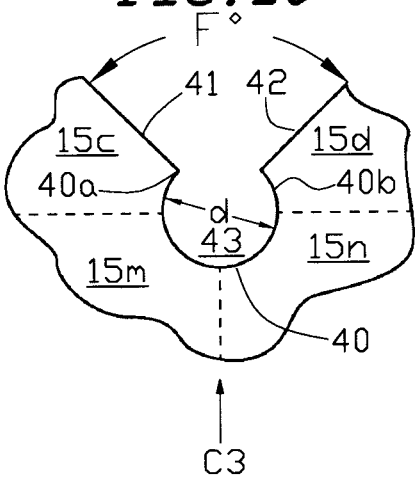
FIG. 10 is an enlarged view of the open corner opening or cut in the outer cover material shown in FIG. 5.
Figure 11:
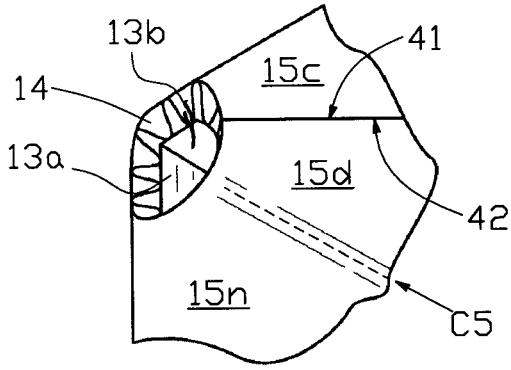
FIG. 11 is an enlarged view of the back top left open corner opening or cut in the yoga block in FIG. 1
Figure 12:
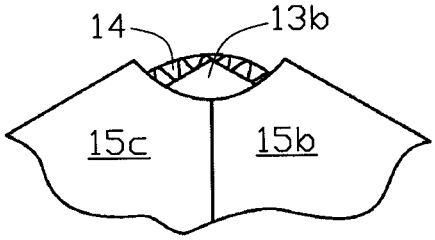
FIG. 12 is an enlarged view of the back top right open corner opening or cut in the yoga block in FIG. 1
Figure 13:
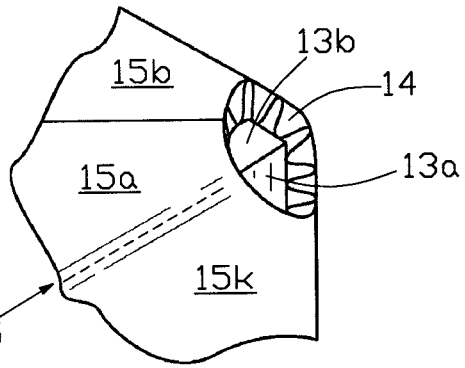
FIG. 13 is an enlarged view of the front top right open corner opening or cut in the yoga block in FIG. 1
Figure 14:
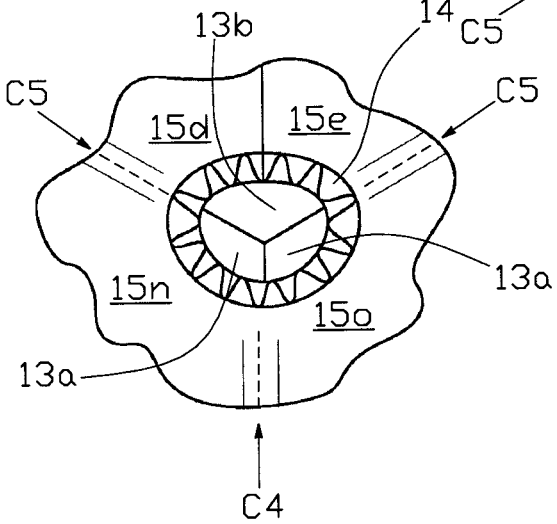
FIG. 14 is an enlarged view of the front top left open corner opening or cut in the yoga block in FIG. 1

An enlarged view of one side corner crease line, namely side corner crease line C3 between block side segments 15*m* and 15*n* is shown in FIG. 5 and FIG. 10. In the embodiment of the invention shown in the figure arcuate region 40 is formed from an arcuate region of a circle with diameter d (typically, but not limiting, 5/16th of an inch) with the opposing ends 40*a* and 40*b* of arcuate region 40 extended linearly outward in opposing adjacent ends 41 and 42 of the block's cover top edge segments 15*c* and 15*d* at an angle of F.° (90 degrees in this example) between them as shown in further detail in FIG. 10 so that when wraparound side yoga block cover outer cover 15 is installed over the double layer of rectangularly-shaped interior yoga block 12 the opposing adjacent ends 41 and 42 meet adjacent to each other as illustrated in FIG. 1. An open corner cover opening is similarly formed with the same dimensions at the bottom of side crease line C3 in FIG. 5 at OBC3 and all of the other open outer cover corners (OTC1, OTC2, OTC4, OBC1, OBC2 and OBC4. Limiting size of an open corner cover opening, d, relative to the overall size of a particular yoga block of the present invention, is sufficiently large so that the outer layer corner of the assembled yoga block does not result in a sharp 90° corner and sufficiently small so that an edge of the double layer of rectangularly-shaped interior yoga block 12 does not protrude through the open corner cover opening.

In one embodiment of the invention, the yoga block's outer yoga block cover comprises an integrated yoga block side and top edge and bottom edge outer cover segments forming each of the plurality of outer cover corner openings at each of the connecting borders between the yoga block's side outer cover and the top edge outer cover and between the yoga block's side outer cover and the bottom edge outer cover. Each of the plurality of outer cover corner openings is formed by an arcuate open region between each of the connecting borders.

In one embodiment of the invention for a method of assembling a yoga block of the present invention wraparound side yoga block outer cover 15 and top central outer cover 16 and bottom central outer cover 17 are attached with an adhesive that may either be provided, for example, as a backing pressure-sensitive adhesive or a drying adhesive applied to the back of the wraparound side yoga block outer cover and top central outer cover and bottom central outer cover.

In another embodiment of the invention an adhesive is applied over the upper facing sheet 13*b* of upper composite structure 13 and over the lower facing sheet 13*c* of lower composite structure 13 to wrapping around the outer cover around the double layer of rectangularly-shaped interior yoga block 12.

In another embodiment of the invention a yoga block assembly kit for forming a yoga block of the present invention is provided. In one example of the invention the yoga block kit comprises a vertically-oriented stack of at least two rectangularly-shaped composite sandwich structures and a flat sheet of a corrugating material for forming an outer cover around the vertically-oriented stack. Each of the at least two rectangularly-shaped composite sandwich structures has a honeycomb core attached to an upper facing sheet and a lower facing sheet and the vertically-oriented stack forms a rectangularly-shaped interior of the yoga block after assembly. The flat sheet of corrugating material forms an outer cover around the vertically-oriented stack. The flat sheet has a linerboard and the flat sheet is scored for a front, back, left and right sides and top and bottom edges of the yoga block, and perforated for a top center section and a bottom center section of the yoga block after assembly and the flat sheet has an arcuate opening at each of the connecting borders.

In one example of the invention the overall dimensions of the wraparound side, top and bottom cover material are 9 inches long along front side segments 15*k* and 15*o* or back side segment 15*m;* 6 inches wide along the left side segment 15*n* or right side segment 15*l*; and 3 inches high for a double stack core 12 (or 6 inches for a quadruple stack core and 9 inches for a sextuple stack core).

In some embodiments of the invention printed matter, for example, advertising material may be applied to a top, bottom or a side of the outer cover when fabricating the flat preform sheet.

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

Spatial orientation terminology such as left or right, top or bottom, front or back and vertical or horizontal are used for convenience in describing examples of the invention without limitation as to claimed subject matter.

The present invention has been described in terms of preferred examples and embodiments. Equivalents, alternatives and modifications, aside from those expressly stated, are possible and within the scope of the invention. Those skilled in the art, having the benefit of the teachings of this specification, may make modifications thereto without departing from the scope of the invention.

The invention claimed is:

1. A yoga block comprising:

a vertically-oriented stack of at least two rectangularly-shaped composite sandwich structures, each of the at least two rectangularly-shaped composite sandwich structures having a honeycomb core attached to an upper facing sheet and a lower facing sheet, the vertically-oriented stack forming a rectangularly-shaped interior of the yoga block; and an outer yoga block cover comprising a corrugating material having a linerboard, the outer yoga block cover forming a plurality of outer cover corner openings into the rectangularly-shaped interior of the yoga block at each one of four top and side corners and at each one of the four bottom and side corners.

2. The yoga block of claim 1 wherein the honeycomb core comprises a honeycomb paper core.

3. The yoga block of claim 2 wherein the honeycomb paper core is a hexagonally-shaped honeycomb paper core.

4. The yoga block of claim 3 wherein the corrugating material comprises a fluting material having the linerboard formed from a kraftliner or a testliner.

5. The yoga block of claim 4 wherein the at least two rectangularly-shaped composite sandwich structures are fixed by an adhesive to each other to form the vertically-oriented stack.

6. The yoga block of claim 4 wherein the outer yoga block cover comprises:

an integrated yoga block side and top edge and bottom edge outer cover forming each of the plurality of outer cover corner openings at each of a connecting borders between the yoga block side outer cover and the top edge outer cover and between the yoga block side outer cover and the bottom edge outer cover.

7. The yoga block of claim 6 wherein each of the plurality of outer cover corner openings ae formed by an arcuate open region between each of the connecting borders.

8. A yoga block kit for assembling a yoga block of claim 1, comprising:

a vertically-oriented stack of at least two rectangularly-shaped composite sandwich structures, each of the at least two rectangularly-shaped composite sandwich structures having a honeycomb core attached to an upper facing sheet and a lower facing sheet, the vertically-oriented stack forming a rectangularly-shaped interior of the yoga block; and an outer yoga block cover comprising a corrugating material having a linerboard, the outer yoga block cover forming a plurality of outer cover corner openings into the rectangularly-shaped interior of the yoga block at each one of four top and side corners and at each one of the four bottom and side corners;

the yoga block kit comprising:

the vertically-oriented stack of the at least two rectangularly-shaped composite sandwich structures, the vertically-oriented stack forming the rectangularly-shaped interior of the yoga block after assembly of the yoga block; and a flat sheet of the corrugating material for forming the outer yoga block cover around the vertically-oriented stack after assembly of the yoga block, the flat sheet comprising the corrugating material having the linerboard, the flat sheet scored for a front, back, left and right sides and a top and bottom edges of the yoga block, and perforated for a top center section and a bottom center section of the assembled yoga block, the flat sheet having an arcuate opening of each of a connecting borders for forming the plurality of outer cover corner openings into the rectangularly-shaped interior of the yoga block at each one of four top and side corners and at each one of four bottom and side corners after assembly of the yoga block.

9. A method of assembling a yoga block comprising:

providing a vertically-oriented stack of at least two rectangularly-shaped recyclable composite sandwich structures, each of the at least two rectangularly-shaped recyclable composite sandwich structures having a honeycomb core attached to an upper facing sheet and a lower facing sheet, the vertically-oriented stack forming a rectangularly-shaped interior of the yoga block; and providing an outer yoga block cover comprising a recyclable corrugating material having a linerboard, the outer yoga block cover forming a plurality of outer cover corner openings into the rectangularly-shaped interior yoga block at each one of four top and side corners and at each one of four bottom and side corners;

the method comprising:

vertically stacking the at least two rectangularly-shaped recyclable composite sandwich structures to form the rectangularly-shaped interior of the yoga block; and wrapping around the rectangularly-shaped interior of the yoga block the yoga block outer cover formed from a single sheet of the recyclable corrugating material having the linerboard, the yoga block outer cover covering a front, back left and right sides, and a top and bottom of the rectangularly-shaped interior of the yoga block and forming the plurality of outer cover corner openings into the rectangularly-shaped interior yoga block at each one of the four top and the side corners and each one of the four bottom and side corners.

* * * * *